US007178341B2

(12) United States Patent
Zborovsky et al.

(10) Patent No.: US 7,178,341 B2
(45) Date of Patent: Feb. 20, 2007

(54) MULTI-ZONE TUBING ASSEMBLY FOR A TRANSITION PIECE OF A GAS TURBINE

(75) Inventors: James Michael Zborovsky, Orlando, FL (US); Raymond Scott Nordlund, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 314 days.

(21) Appl. No.: 10/871,476

(22) Filed: Jun. 17, 2004

(65) Prior Publication Data

US 2005/0279099 A1 Dec. 22, 2005

(51) Int. Cl.
*F02C 7/12* (2006.01)

(52) U.S. Cl. ..... 60/806; 60/752

(58) Field of Classification Search ..... 60/266, 60/267, 752, 806; 165/DIG. 538
See application file for complete search history.

(56) References Cited

U.S. PATENT DOCUMENTS 4,422,288 A 12/1983 Steber
4,819,438 A 4/1989 Schultz
5,819,525 A * 10/1998 Gaul et al. ..... 60/806
5,906,093 A 5/1999 Coslow et al.
6,173,561 B1 * 1/2001 Sato et al. ..... 60/752
6,463,742 B2 10/2002 Mandai et al.
6,523,352 B1 2/2003 Takahashi et al.
6,553,766 B2 * 4/2003 Shimizu et al. ..... 60/752
6,662,568 B2 12/2003 Shimizu et al.
6,890,148 B2 * 5/2005 Nordlund ..... 60/806
2003/0167776 A1 9/2003 Coppola

FOREIGN PATENT DOCUMENTS

EP 0 926 324 A1 6/1999

* cited by examiner

*Primary Examiner*—L. J. Casaregola

(57) ABSTRACT

A replaceable section (25) of force-cooling tubing assembly (21, 22) for attachment to a transition piece (5) of a gas turbine is comprised of two ends (54, 70) fashioned for attachment by removable unions (52) to adjoining parts of a force-cooling tubing assembly. When assembled thereto to complete the assembly, the replaceable section 25 provides for fluid communication between a manifold (3) and the transition piece (5) for either the supply or return of cooling fluid. A transition piece (5) in combination with two such assemblies, one a supply assembly (21), the other a return assembly (22), comprises a field-installable transition piece assembly (10) that provides for rapid and easy installation. The features of the replaceable section (25) include a relatively inflexible bracing zone such as a bracing member (58) having a support structure such as a lateral plate (60) that extends to the transition piece (5), a formed tubing bend (64) typically forming a U-bend, and optionally a second flexible component comprised of an inline flexible coupling (56).

16 Claims, 5 Drawing Sheets

MULTI-ZONE TUBING ASSEMBLY FOR A TRANSITION PIECE OF A GAS TURBINE

FIELD OF THE INVENTION

This invention relates generally to the field of gas combustion turbines, and more particularly to tubing assemblies that supply forced air or steam coolant to transition pieces of a gas turbine.

BACKGROUND OF THE INVENTION

Gas turbines are well known in the art of power generation. A gas turbine comprises a compressor section where air is pressurized. This air then flows to a plurality of radially arranged combustion chambers in which fuel is combusted to form a hot combustion gas. The hot gas passes through a transition piece into a first stage of a turbine where the enthalpy of the gas is converted into mechanical energy. It is noted that transition piece alternatively is referred to as a "tail pipe" or "transition duct" by some in the field. Prior art references that are hereby incorporated by reference, particularly for the teachings of the structure of transition pieces and for the sources of stresses thereto, are: U.S. Pat. No. 4,422,288 to Steber, issued Dec. 27, 1983; U.S. Pat. No. 5,906,093 to Coslow et al., issued May 25, 1999; U.S. Pat. No. 6,463,742 B2 to Mandai et al., issued Oct. 15, 2002; and U.S. Pat. No. 6,662,568 B2 to Shimizu et al., issued Dec. 16, 2003. Also of interest is U.S. Pat. No. 6,523,352 B1, to Takahashi et al., issued Feb. 25, 2003, incorporated by reference in its entirety.

The transition piece receives hot combustion gases. As such the transition piece and components attached thereto are subject to stress from high temperatures, vibrations, and extreme temperature gradients over long periods of operation. Some gas turbine transition pieces are cooled by forcing air over the outside of the units while other transition pieces contain cooling channels through which forced air or steam flow to cool the transition pieces. The latter types are known generally as forced-cooled transition pieces.

Forced-cooled transition pieces include steam-cooled transition pieces in which steam is supplied to the transition piece via intake (i.e., supply) tubing and in which separate exhaust tubing returns the hotter steam from the transition pieces back to a steam system. For example, one set of steam-cooling operational parameters for cooling a transition piece include: inlet (i.e., supply) steam around 500 degrees Fahrenheit ("° F.") inlet pressure around 260 pounds per square inch ("psi") and outlet or exhaust steam temperature around 1000° F.

Prior art piping or tubing assemblies that connect forced cooling fluid supply and return systems to a transition piece are comprised of rigid pipe that is welded at each bend. Forced air and steam are the common force-cooled fluids, and a unitary manifold is a common structure to convey supply side and return side fluids. An example of a prior art welded tubing assembly that transports steam is shown in FIG. 1. A supply tubing assembly 2 transports steam from an outlet of a steam manifold 3 to a steam inlet port 4 of the transition piece 5. A return or exhaust tubing assembly 6 carries return steam heated by passage through channels in the transition pieces 5 from the steam outlet port 7 to the return port 8 of the steam manifold 3. Although it is known in the art to provide bracing along the lengths of this welding tubing, as indicated in FIG. 1 by brace 9, this brace merely attaches a uniformly rigid welded tubing assembly to parts of the transition piece. The tubing assembly to both sides of such bracing is of the same rigid pipe and is welded, as is taught in the prior art.

Construction of such welded rigid pipe assemblies requires substantial labor. Also, if the fit between manifold and port is not accurate, and/or if there is improper handling during shipping or installation, static loading may be imposed on the tubing assembly that shortens its useful life.

Temperature stresses may arise from the sustained high temperature on a component of the tubing assembly, from exposure to a high temperature gradient along a length of material, or from both. In addition to temperature stresses the transition piece and the tubing assemblies associated with it are subject to vibrations, such as from the varying nature of the combustion, and from related vibrations transferred from the manifold. As noted above, certain stress might accrue from undesirable static loading on the assembly such as when improper handling, by the supplier and/or due to improper installation, strain one or more of the tubing assemblies or their components. As the tubing assemblies or their components having such static loading are then brought up to operational temperature, and remain there for extended operating periods, additional stress from the initial static loading can contribute to the other stresses.

BRIEF DESCRIPTION OF THE DRAWINGS

FIG. 5A provides a more detailed view of the backing plate on the transition piece, and the lateral plate of the bracing member.

DETAILED DESCRIPTION OF THE INVENTION

Figure 1:
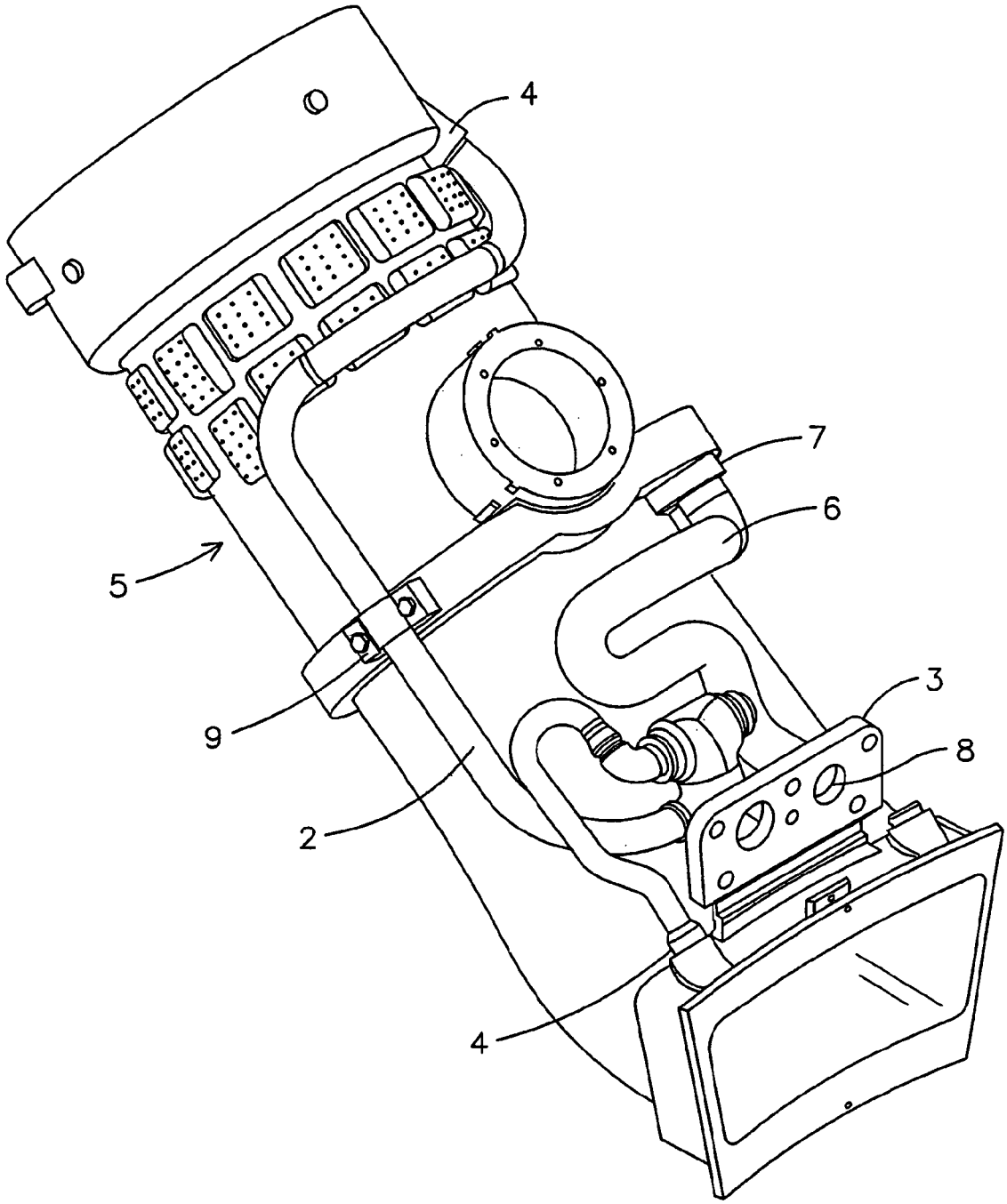
FIG. 1 provides a perspective view of one example of a prior art welded tubing assembly that transports steam to and from a transition piece.

For the figures described herein, unless otherwise indicated like reference numerals refer to the same or similar structures identified in previous figures. Also, as used in the specification and claims, the terms "inlet," "intake" and "supply" are taken to indicate the same with regard to a tubing assembly, and "outlet," "return," and "exhaust" likewise are taken to indicate the same with regard to a tubing assembly.

Also, the terms "replaceable" and "removable" are taken to mean the same thing when referring to tubing assembly components that fluidly communicate with the cooling system in a transition piece. Owing to its removability and ease of replacement, such tubing assembly sections are also termed "field-installable." The term "field-installable" also applies to certain combinations of the present invention that comprise a transition piece and one or more components of the tubing assembly, such as the replaceable sections for the intake and outlet sides of the forced cooling system. As is disclosed herein, such field-installable combinations provide for ready installation and/or replacement of worn units without a need for extensive welding in situ, and avoids the installation of transition pieces having extensive pre-welded cooling system tubing assemblies. Thus, the terms "replaceable," "removable" and "field-installable" as applied to these components and assemblies indicates that these are more readily and more easily installed or changed out than known components and assemblies.

One embodiment of the present invention is a flexible tubing assembly for conducting a fluid for forced cooling of a transition piece of a gas turbine where that assembly comprises an inline flexible connector. Another embodiment of the present invention is a removable flexible tubing assembly for conducting a fluid for forced cooling of a transition piece of a gas turbine the assembly being with or without the inline flexible connector. Another embodiment of the present invention is a forced cooling transition assembly in which the transition piece comprises heat transfer channels ending in inlet and outlet chambers and further comprising a tubing assembly connecting to the inlet and outlet chambers that advantageously transfers certain loads to the transition piece and that further comprises a formed tubing bend and a flexible inline connector. Combinations are disclosed that include a transition piece together with a tubing assembly. Specific embodiments of the present invention are described below making reference to figures attached hereto.

Figure 2:
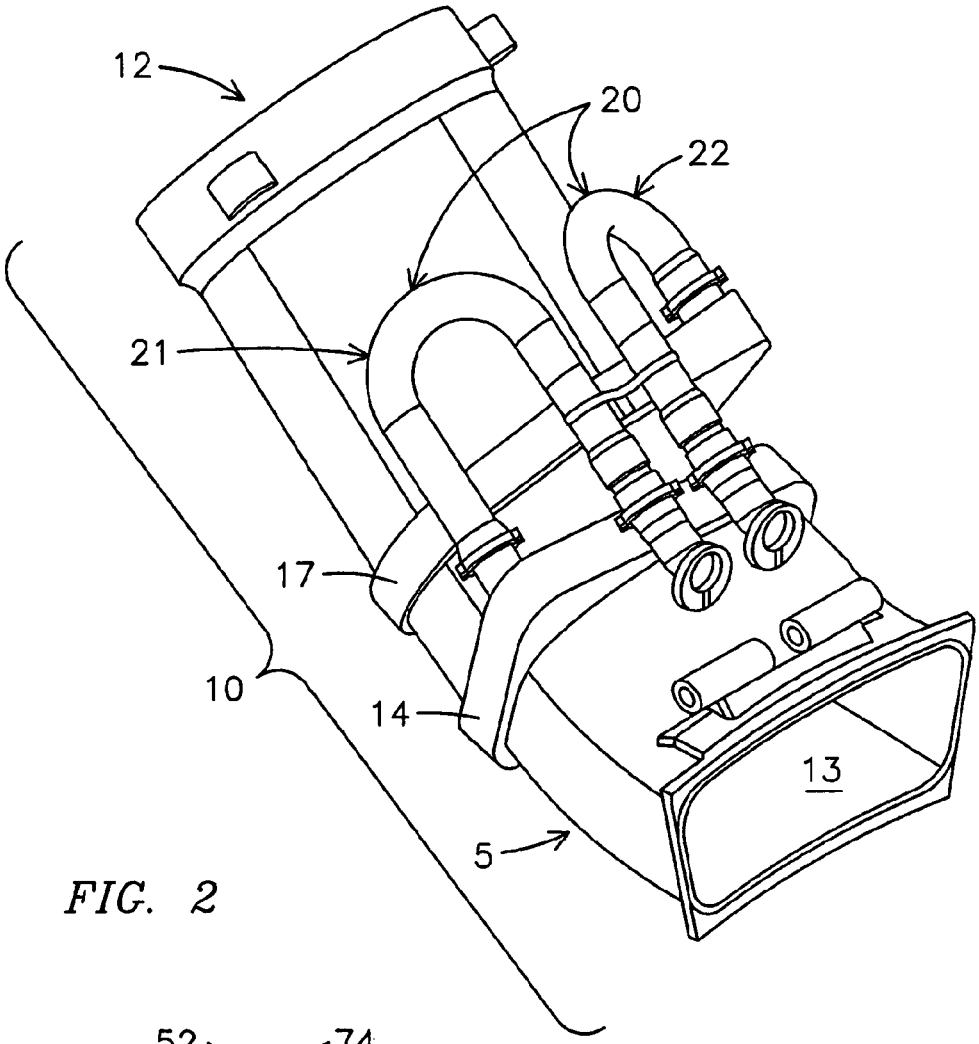
FIG. 2 provides a perspective view of one embodiment of a removable force-cooling tubing assembly installed on a gas turbine transition piece. Viewable are both the intake and outlet tubing assemblies.
Figure 3:
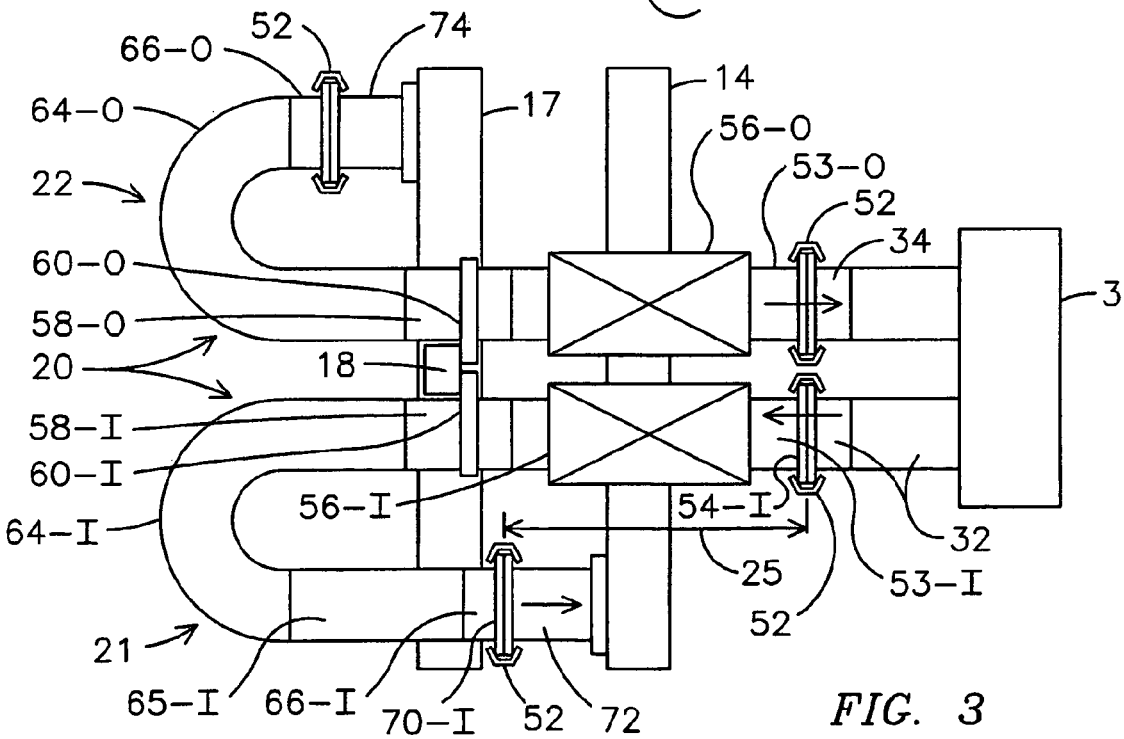
FIG. 3 provides a schematic top view of the removable force-cooling tubing assembly of FIG. 2.

FIG. 2 provides a perspective view of one embodiment of the removable force-cooling tubing assembly 20 of the present invention. This provides force-cooled fluid for cooling a transition piece 5. Air and steam are common force-cooled fluids. Steam is discussed in the embodiments. However, any force-cooled fluid may be used in the apparatuses disclosed herein. As depicted in FIG. 2, assembly 20 is divided into an inlet tubing assembly 21 and an outlet tubing assembly 22. FIG. 3 more clearly displays the removable force-cooling tubing assembly 20 of FIG. 2, showing certain components as positioned between the steam manifold 3 and an inlet chamber 14 and an outlet chamber 17 of transition piece 5 (not otherwise depicted in FIG. 3).

While it is recognized that a manifold is most typically used to supply fluid for forced cooling of transition pieces, this component is more generally referred to as a "forced cooling fluid supply." A forced cooling fluid supply, as used herein, including the claims, is taken to include an apparatuses, such as the manifolds depicted in the figures, that has both delivery and return conduits. A forced cooling fluid supply also is taken to mean an apparatus that separately provides a delivery or a return conduit, so that one such apparatus comprises a supply (i.e., delivery) side, and a second such apparatus comprises a return (i.e., outlet) side with respect communicating cooling fluid with the transition piece.

As seen in FIG. 2, both the inlet tubing assembly 21 and the outlet tubing assembly 22 of the removable force-cooling tubing assembly 20 are connected to transition piece 5. The transition piece 5 in combination with the inlet tubing assembly 21 and the outlet tubing assembly 22 comprise a field-installable transition piece assembly 10. The components and relevant aspects of the transition piece 5 are described as follows. The transition piece 5 has a forward (or inlet) end 12 directed toward and attaching to the exhaust end of a combustion chamber (not shown) and an aft end 13 directed toward and attaching to the intake end of typically the first stage of a turbine (not shown). The transition piece 5 also is comprised of the inlet chamber 14, which receives steam from the steam manifold 3. Fluidly connected with the inlet chamber 14 are a plurality of cooling channels within the transition piece 5 through which the steam passes. These cooling channels are not shown in FIG. 2. The forced fluid receives heat from the body of the transition piece thereby cooling the transition piece 5 as the steam circulates out of the transition piece. The steam leaves the channels within the transition piece 5, collecting in and passing from outlet chamber 17.

To distinguish from the inlet end 12 and aft end 13, which are for combustion gases, an inlet chamber, such as inlet chamber 14, also is identified as a "cooling inlet chamber," and an outlet chamber, such as outlet chamber 17, also is identified as a "cooling outlet chamber."

While not necessarily true for all embodiments of the present invention, the herein described components of the inlet tubing assembly 21 and an outlet tubing assembly 22 are shown as having the same or similar components and relationships there between. Accordingly, discussion of component characteristics of the supply side assembly applies as appropriately to the outlet tubing assembly 22. Where convenient, part identification for similar parts of the respective assemblies are distinguished by the suffix "-I" for inlet tubing assembly components, and by "-O" for outlet tubing assembly components. When no suffix is used for such components, the discussion about such component may apply to either or both of the inlet tubing assembly 21 and an outlet tubing assembly 22. This identification system does not apply to the structures to which the respective assemblies attach at their respective ends, nor to the removable unions as described herein.

Also, it is noted that, depending upon design criteria for a particular transition piece, the design and layout of an inlet tubing assembly may differ substantially from the design and layout of an outlet tubing assembly, and still be within the scope of the present invention. For example, referring to FIG. 1 it is observed that the inlet tubing assembly supplies two inlet chambers, whereas the outlet tubing assembly only emanates from one outlet chamber. The features of the present invention are adaptable to such design criteria, chamber placements, and the like, without departing from the scope of the claims provided.

The inlet tubing assembly 21 receives steam from a steam supply source, shown in FIG. 3 as a steam manifold 3, via a manifold lead-out pipe 32 affixed to said manifold 3. In the embodiment depicted in FIG. 3 the manifold lead-out pipe 32 is solidly affixed to the steam manifold 3 and at its free or distal end is flared to engage a removable union 52 that reversibly joins said distal end to a matching end 54-I of the inlet tubing assembly 21. More generally, an end, such as end 54-I, is adapted for joining using a removable union (such as with removable union 52), such as by, but not limited to, flaring.

Figure 4:
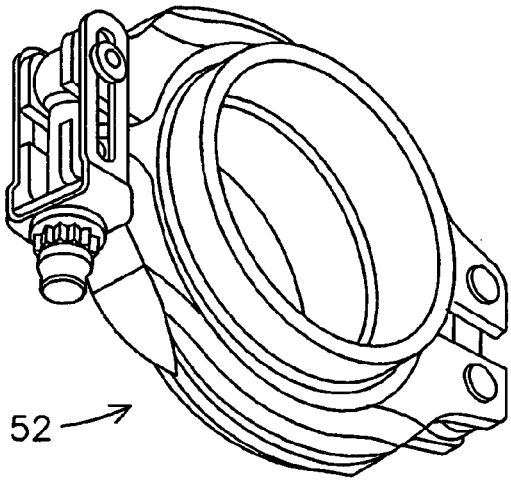
FIG. 4 provides a perspective view of a V-band clamp style of a removable union.

A V-band clamp is one type of removable union 52 that is used in embodiments such as those depicted in FIGS. 2 and 3. FIG. 4 provides a close-up view of a V-band clamp type of removable union 52. This type of removable union 52 is easily changed out and non-leaking during standard operating conditions of the turbine and its steam cooling system. By non-leaking under such operational conditions, for the purposes of this application, including the claims appended hereto, it is meant that at such removable unions there is no appreciable loss of fluids from within the tubing to the exterior thereof that results in a recognizable impact on the delivery of fluids by such tubing. Other types of removable unions as are known in the art may be used in this and in other locations where a V-band clamp-type union fitting is depicted. Among other types, without being limiting thereto, is a bolted flange union.

The assemblage of components that comprise the tubing assembly between the two removable unions 52 (either for the inlet or the outlet assemblies) collectively is referred to as a "removable tubing section." The following describes components of one such assemblage, of an inlet tubing assembly 21 as depicted in FIGS. 2–3. First, meeting with the flared and shaped distal end of the manifold lead-out pipe 32 is a first straight-tube 53-I. This first straight-tube 53-I has a flared and shaped end 54-I that meets and joins with the free end of the manifold lead-out pipe 32. The other end of the first straight-tube 53-I is made integral with, such as by welding, a flexible coupling 56-I. While shown without detail in FIG. 3, the flexible coupling 56-I may be selected from any suitable type of flexible connector capable of withstanding the temperature pressure and vibrational conditions experienced by this component. For example but not to be limiting, the flexible coupling 56 may be selected from: a dual spherical coupling (i.e. having a ball and joint union at each end (for instance, Perkin-Elmer Fluid Sciences (Baltimore, Md.) model #43428-175); a bellows-type coupling; a spring clip coupling; and metal flexible hose. Flexible couplings have the capability to take up axial and lateral movement, that is, to impart axial and lateral flexibility into an assembly, and have no or limited leakage.

Figure 5A:
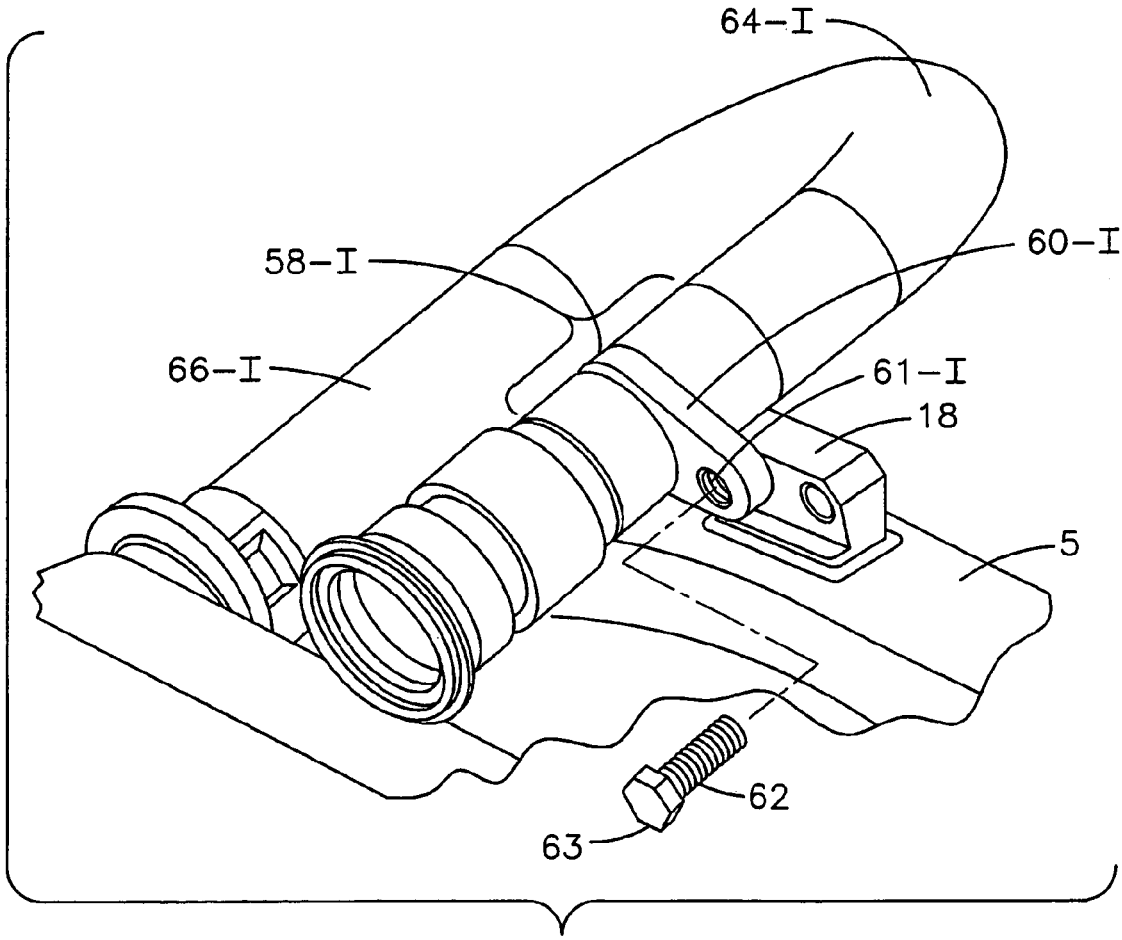
FIG. 5A provides a perspective view of a modified embodiment of the inlet tubing assembly as depicted in FIGS. 2 and 3.

Downstream of the flexible coupling 56-I is a bracing member 58-l having a bore passing through it, to fluidly communicate the cooling fluid to adjacent components, and comprising an integral lateral plate 60-I. The lateral plate 60-I has a hole 61 (behind bolt head 63 in FIG. 5A, and observable in FIG. 5B), and is aligned so that hole 61 aligns with a matching hole (not observable in FIG. 5A) in an axial stop backing plate 18 fixed to the transition piece 5. A bolt 62 having bolt head 63 is shown in FIG. 5A. This passes through the hole 61 of lateral plate 60 and thereby securing the inlet tubing assembly 21 to the transition piece 5 at this point. When so secured the attachment to the axial stop backing plate actually provides bracing of the inlet tubing assembly 21 in all three dimensions (i.e., axial, lateral and longitudinal). When in other embodiments (not shown) a bolt is not used or is fashioned so as to provide space between it and the perimeter of the hole 61 of lateral plate 60 the effect of such arrangements exclusively or primarily is along one dimension and the stopping effect is more accurately described as "axial." Other arrangements can selectively reduce or eliminate moments and/or forces along any axes. Thus although the piece is named an "axial stop backing plate" it is appreciated that it can in certain embodiments brace a flexible tubing assembly against motion from non-axial directional forces via a secure attachment.

Figure 5B:
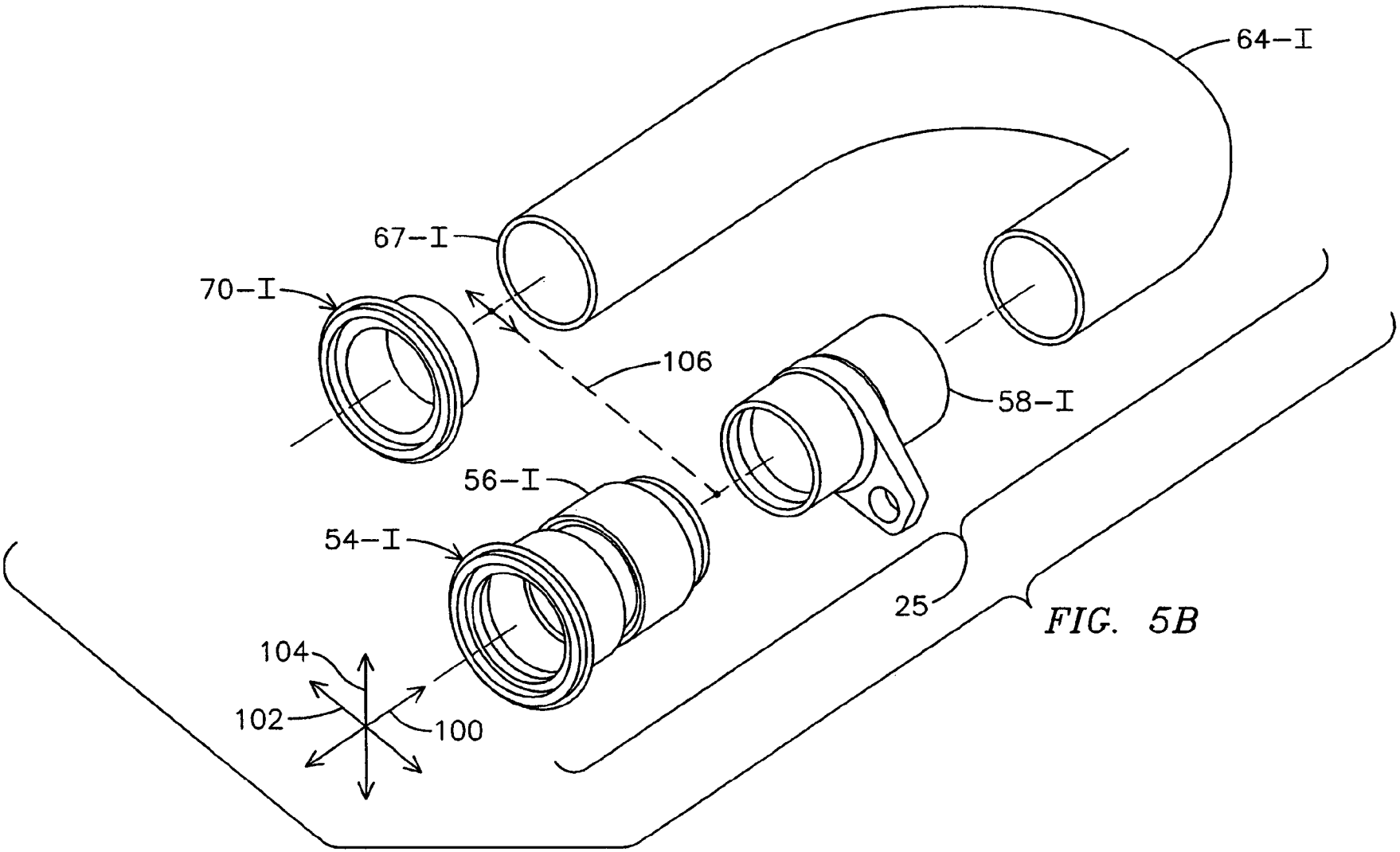
FIG. 5B provides an exploded view of the components of the inlet tubing assembly depicted in FIG. 5A, however eliminating one component and modifying another component to compensate for this elimination.

In general, a bracing member is designed to react out plug loads rather than tubing or other components that are positioned farther away from the source of the plug load force. Because the bracing member 58-I transfers load and is under stress during the operation of the gas turbine it is fabricated to withstand such stress. For example, without being limited, this component may be made by casting, by forging, by machining stock material (which in some embodiments includes the lateral plate 60-I), or by welding together a subassembly comprising rigid pipe or a pipe fitting and the lateral plate. In FIG. 5B, an exploded view, the embodiment of bracing member 58-I depicted therein is a single piece that has been machined to the form shown.

Downstream of the bracing member 58-I is a formed tubing bend 64-I, here formed to comprise a U-shaped bend of the inlet tubing assembly 21. This formed tubing bend 64-I has a reduced stiffness compared to standard pipe of comparable size (i.e., 1.75 inch outside diameter tubing size compared to 1.5 inch nominal pipe diameter), where that pipe forms a similar bend with welded fittings. By standard pipe is meant the iron pipe normally used to supply transition piece assemblies with a forced cooling fluid. Standard pipe sizing has been used in the past to supply transition piece assemblies with a forced cooling fluid. To develop proper sizing and other specifications for a formed tubing bend as used herein, one skilled in the art may utilize, for instance, finite element modeling software programs, inputting data relevant to a particular turbine and transition piece. As to the specific example depicted in the FIGS. 2 and 3, the reduced stiffness in the area, or the zone, of the inlet tubing assembly 21 contributes to easier assembly and reduced high cycle fatigue. By having less stiffness, or rigidity, the formed tubing bend provides radial flexibility.

In the embodiment depicted in FIGS. 2 and 3, the formed tubing bend 64-I's lower relative stiffness derives from its composition, thickness, and the form of manufacture, namely forming, rather than casting or welding together pipe with fittings.

As depicted in FIGS. 2 and 3, downstream of the section of formed tubing bend 64-I is a spacer tube 65-I. This straight section of tubing is joined with the end of formed tubing bend 64-I at one end, and is joined to a terminating straight tube 66-I at the other end. (It is noted that the outlet tubing assembly in FIGS. 2 and 3 lack such spacer tube, as this is not required given the position of outlet chamber 17). As depicted in FIGS. 2 and 3 the end 70-I of the terminating straight tube 66-I is flared and shaped to matably contact the matching flared and shaped end a chamber inlet pipe 72 extending from the inlet chamber 14. This is to provide for joining, as with a V-type clamp removable union 52, so as to form a non-leaking joint or union.

As noted above the component structures of the outlet tubing assembly 22 may essentially the same as for the above-described inlet tubing assembly 21. However as shown in FIGS. 2 and 3 the outlet tubing assembly 22 attaches to an chamber outlet pipe 74 leading from the outlet chamber 17 of the transition piece 5. The other end of the outlet tubing assembly 22 attaches to a manifold lead-in pipe 34 that, as depicted in this example, is welded to the steam manifold 3. As for the fittings joining the inlet tubing assembly 21, the end of manifold lead-in pipe 34 so joining the outlet tubing assembly 22 is shaped and flared to matably contact the similarly flared and shaped end of a first straight tube 53-O which is the end component of the outlet tubing assembly 22. It is noted that in other embodiments, a flexible coupling, such as component 56 in FIG. 2, may be manufactured to include a flared fitting at one end. In such embodiment the need for a first straight tube, such as component 53-O, is eliminated.

Whereas the inlet tubing assembly 21 is definable as the entire section of tubing between the steam manifold 3 and the inlet chamber 14, the readily removable part of the inlet tubing assembly 21 is a replaceable section, 25 (alternately referred to as a "removable tubing section") which is comprised of the components between ends 54-I and 70-I (see FIG. 5B).

As described above for the embodiment in FIGS. 2 and 3, the components work together to provide a superior alternative to the prior art rigid welding tubing assemblies that have complicated routing and are difficult to manufacture. The flexibility of the design permits one end to be rigid while the other end endures thermal and dynamic displacements. Generally, the increased flexibility compared to a welded rigid pipe assembly derives from one or a combination of: integrating a flexible coupling into the tubing section; simplifying the geometry; reducing the number of welds; and fabricating a formed tubing bend component that has reduced stiffness compared to standard pipe with welded fittings. The use of the formed tubing bend component imparts a plug load as a force-cooled fluid flows through it, due to momentum changes imposed through it by the bend. Also, high plugs loads due to pressure differentials and flow cross-sectional areas, particularly through the flexible coupling, need to be managed. The bracing member 58, having a connection to the transition piece, controls such forces and isolates the flexible coupling from the formed tubing bend. It also reduces moment loads to the removable unions 52, to stay within their design capabilities. It is noted that other embodiments, described below, may utilize fewer than the components described in this embodiment. To varying extents this will result in a different dynamic response and different load transfers between the remaining components.

Further as to a bracing member and how to transfer load from it to the transition piece, the above-described lateral plate 60 is but one of a number of alternatives for a support structure that is integral with or appended to the bracing member. The purpose of such support structure is to transfer loads to the transition piece at a point along the length of the tubing section. The point at which such load is transferred generally is identified by the presence of a load-receiving member that may be integral with or attached to the transition piece. The axial stop backing plate 18, discussed above, is but one example of a load-receiving member. The transferring of load to the transition piece serves to isolate a component of the tubing assembly on one side of the support structure from loads generated on the other side. Depending on the shapes and arrangement of elements, and how they contact or are attached to one another, only axial loads may be transferred, loads from all three dimensions may be transferred, or other combinations of moments and/or forces may be transferred. For example, a support structure may be in the form of a plate as shown in FIG. 2, a pin or bolt, or any other shape of material that can extend from the tubular part of the bracing member to make a desired contact with the transition piece, or with a member made to extend from the transition piece.

The shapes of a particular support structure and the shapes of the load-receiving member may vary depending on a number of factors, particularly the desired axes, the anticipated loads, and specified tolerances. For example, not to be limiting, the support structure may be a cylindrical rod having a hole drilled through it, and through this hole passes a pin that extends from a plate affixed to the transition piece. Here, the pin and plate comprise the load-receiving member. Alternatively, a plate or bolt may extend from one side of the bracing member with its end positioned into a groove in the transition piece, where the travel in the groove is limited at one end that serves as an axial stop. Here, the groove, including its side and end walls, comprises the load-receiving member. Alternatively, the support structure may be a groove on the bracing member flanked by two spaced apart ridges, where a yoke extending from the transition piece is positioned between the ridges. Then, upon axial movement the tubing is stopped when the yoke meets one of the ridges. Here, the yoke is the load-receiving member. These and any other mechanical designs for associating the bracing member to the transition piece, for the purpose of providing axial or other force transfer, as known to those of ordinary skill in the art, may be used to adapt such components to transfer loads in order to practice this aspect of the invention. It also is noted that the design may include more than load-receiving member on a transition piece, for example, not to be limiting, a first load-receiving member (such as a backing plate) for contact with the inlet tubing assembly 21, and a second load-receiving member (such as a backing plate) for contact with the outlet tubing assembly 22.

FIG. 5B also depicts basic information about the directionality of flexibility of components of the present invention. Line 100 in FIG. 5B defines axial displacement. Line 102 defines sideways displacement, and line 104 defines longitudinal displacement. As used herein to describe the flexibility of flexible couplings, lateral displacement is comprised of both sideways and longitudinal movements. Thus, having lateral flexibility allows displacement both sideways and longitudinally. Also, considering line 106 in FIG. 5B, this line depicts a radius of the bend of the formed tubing. Due to reduced stiffness, the end 67-I of formed tubing bend 64-I may be displaced inward, to obtain a smaller radius, or displaced outward, to obtain a larger radius. This defines radial flexibility as used herein to describe the formed tubing bend. Such radial flexibility provides for easier installation, particularly the fit-up of ends of tubing and mounting hardware. It is acknowledged, additionally, that due to the low stiffness of the formed tubing bend, the end 67-I may alter its relative position along 106 (i.e., it may possess flexibility in addition to the radial flexibility as defined herein).

Figure 6:
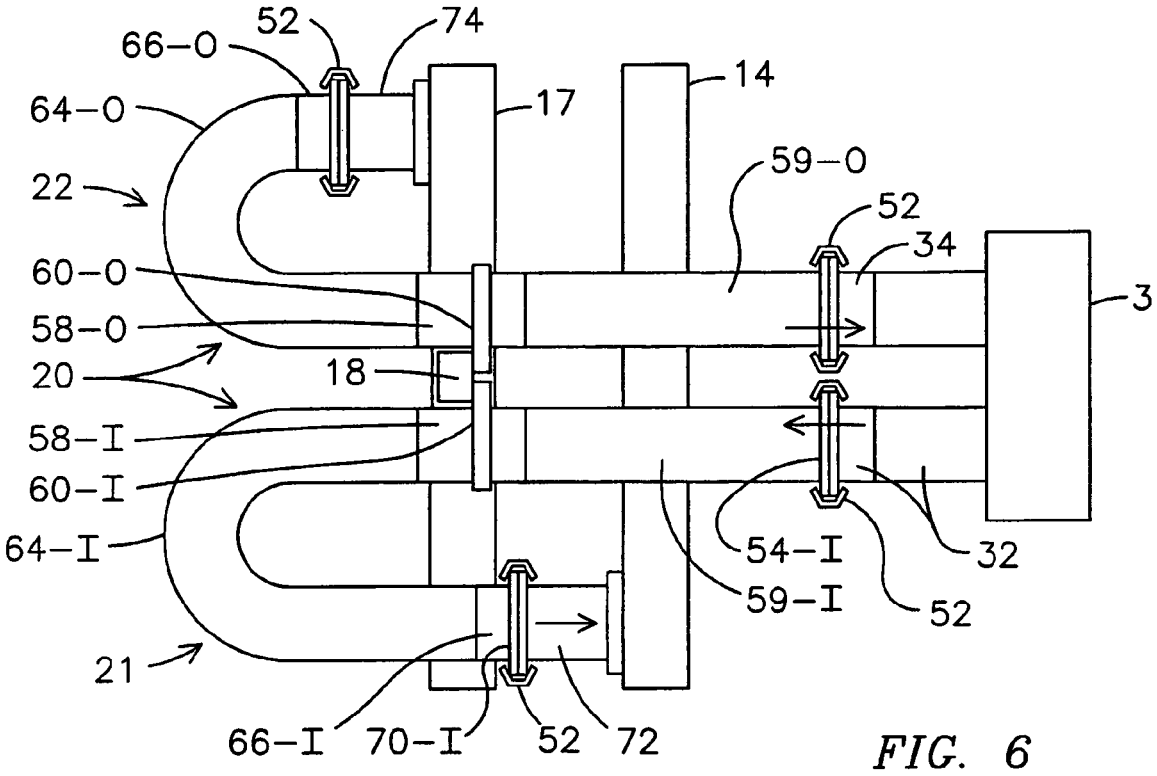
FIG. 6 depicts a modified embodiment of the foregoing examples depicted in FIGS. 2–3, in which a straight section of tubing is substituted for each of the flexible couplings.

FIG. 6 depicts another embodiment of the present invention in which there is no flexible coupling as found in the embodiment depicted in FIGS. 2–3. Here there is simply a straight section 59-I, such as of rigid tubing, connecting the removable connection toward the manifold and the bracing member 58-I. An analogous straight section, 59-O, connects the outlet tubing assembly 22 to the respective manifold fitting. Further, each of the intake and outlet tubing assemblies of this embodiment is comprised of two ends matable to adjoining tubes via a removable union fitting, 52, a formed tubing bend 64, and, as noted, the bracing member 58. Although lacking the inline flexible coupling, the embodiment in FIG. 6 nonetheless provides the benefits of: means for rapid repair and replacement via the removable unions; tolerance of fit and resilience to vibrational and temperature stress due to the U-shaped bend of the formed tubing bend 64; and vibration damping via the bracing member 58 securing to the axial stop backing plate 18 of the transition piece 5 via a lateral plate 60.

It is appreciated that another aspect of the invention is any one of the tubing assemblies disclosed and described above in combination with the transition piece that is connected thereto. For example, and not to be limiting, the transition piece 5 in FIG. 2 in combination with both the inlet tubing assembly 21 and the outlet tubing assembly 22 is an embodiment of such aspect of the invention. Further, kits comprising one or more flexible tubing assemblies (i.e., supply and exhaust), together with a transition piece for which they are sized and designed for connection thereto, are also aspects of the present invention.

Figure 7:
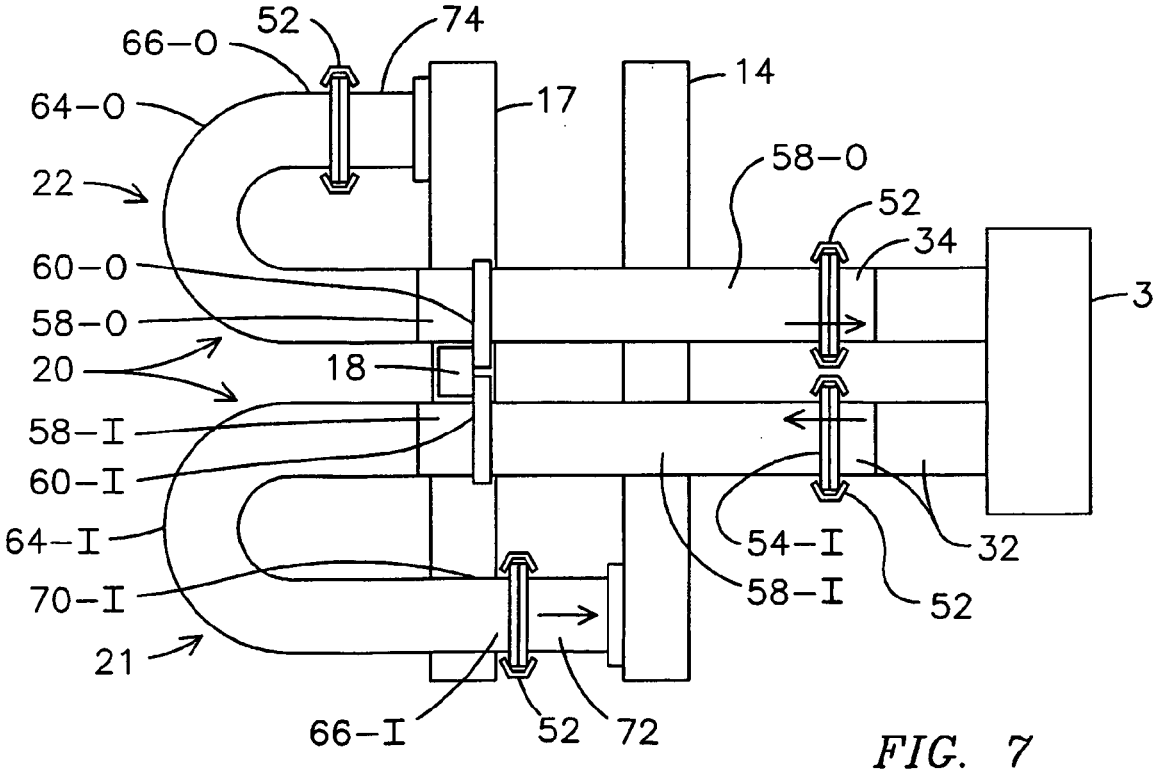
FIG. 7 depicts a further modified embodiment of the foregoing examples depicted in FIGS. 2–3, in which a terminal component of the tubing assemblies depicted in FIGS. 2–3 is not present, and is functionally replaced by an extension of another component.

Also, it is noted that in other embodiments certain components of the assemblies disclosed above may be eliminated without detracting from the invention. Without being limiting, one example of such component reduction is shown in FIG. 7. Here, with FIG. 6 as a starting point, the tubing assemblies 21 and 22 may be fashioned and used without, respectively, the straight sections 59-I and 59-O shown in FIG. 6. In such embodiment in FIG. 7, each of these assemblies' bracing members 58-I and 58-O is designed and fabricated to extend to the manifold. Similarly, again not to be limiting (and not shown in FIG. 7), each of the formed tubing bends 64-I and 64-O may extend to meet the fittings from the inlet or outlet chambers, 14 and 17 respectively, of the transition piece 5. This eliminates the terminating straight tubes 66-I and 66-O shown in FIG. 3. In such embodiment, the end of the each of formed tubing bends 64-I and 64-O is shaped to appropriately mate with the fitting to which it is to be reversibly attached by use of removable union fittings 52.

Although the examples disclosed herein are comprised of removable unions at both sides of tubing assemblies, it is noted that other embodiments of the present invention have an inlet or an outlet tubing assembly comprised of a bracing zone (such as bracing member 58-I in FIG. 2) having a means to contact the transition piece (such as the lateral plate 60 in FIG. 2), and a formed tubing zone (such as formed tubing bend 64 in FIG. 2). Such embodiments are assembled to the transition piece without removable unions, and may or may not include an inline flexible coupling (such as flexible coupling 56 in FIG. 2). Attachment without removable unions may include welding to the respective ends, i.e., to the manifold and to the inlet and outlet chambers. It is noted that such embodiments will take longer to replace than the embodiments utilizing the removable unions at both ends of an intervening inlet or outlet tubing section.

Thus, by virtue of the examples and discussion herein, it is appreciated that one aspect of the present invention is the realization that a way to solve the problems identified in tubing assemblies to transition pieces that provide force-cooling is to provide both a bracing zone and a formed tubing zone. That is, considering only one of the inlet or the outlet tubing assemblies, there is a bracing zone that transfers loads from the tubing assembly to a point on the transition piece (i.e., via the lateral plate 60 of the bracing member 58). And there also is a formed tubing zone comprised of formed tubing that is less rigid than comparable pipe with welded fittings (i.e., the U-shaped formed tubing bend 64). These two zones, in contrast to the tubing assemblies in the art, have compositions imparting different levels of rigidity, and thus may be considered heterogeneous. Such embodiments of the present invention are considered "dual-zone" assemblies. Advantageously in examples provided herein, the formed tubing zone may include a U-shaped bend that is important in redirecting the flow of force-cooling fluid 180 degrees, as is done to comport with standard designs of gas turbines.

Additionally, embodiments may also include a third zone comprising a flexible coupling. This zone, a flexibility zone, is positioned between the bracing zone and the manifold, and is characterized by such coupling's ability to lessen the loads and consequent stress and wear on other components due to its flexibility. More particularly, for instance (not to be limiting), a flexibility zone comprising a flexible coupling provides axial and lateral flexibility. Accordingly, and more generally, the embodiments of the present invention are considered to be comprised of multi-zone tubing assemblies that supply forced-cooled fluids to a transition piece of a gas turbine engine.

It also is appreciated that the term "pipe," as used herein to describe the parts emanating from the force-cooled fluid supply (i.e., manifold), and the inlet and outlet chambers of the transition piece, which fluidly connect with the removable sections described herein, may include any type of structure or assembly that fluidly transmits the force-cooled fluid in place of the sections of pipe described and illustrated herein. For instance, not to be limiting, a molded transition piece inlet assembly may have a structure to connect to the removable sections described herein which does not literally have a separate piece of pipe welded thereto. Such structure, which may alternately be identified as an "extended port," is considered to fall within the scope of the functional definition of a "pipe" as used herein.

Further, in view of the advantages of the assemblies described above, including assemblies that are comprised of a transitional piece and two replaceable sections of force-cooling tubing (as depicted in FIGS. 2 and 3), it is appreciated that another aspect of the present invention are methods of installation of such assemblies. For instance, and not to be limiting, one method of installing a transition piece assembly is:

1. aligning a transition piece so its forward end meets the end of a combustor and its aft end meets the entry to a turbine first stage;
2. attaching an inlet support at the forward end;
3. attaching an exit support at the aft end;
4. installing a first replaceable section of force-cooling tubing to fluidly connect a supply port from a manifold and a port on an inlet chamber of said transition piece; and
5. installing a second replaceable section of force-cooling tubing to fluidly connect a return port of a manifold and a port on an outlet chamber of said transition piece wherein said installing of steps 4 and 5 comprise fastening removable unions at both ends of each of said first and second replaceable sections to form non-leaking unions.

It is appreciated that the above steps 1–3, and variations of these as are known in the art, more generally is described as "installing a transition piece to join a combustor and turbine first stage."

Alternatively, it is appreciated that in other instances, a field-installable transition piece assembly 10, comprising a transition piece 5 assembled in combination with the inlet tubing assembly 21 and the outlet tubing assembly 22, may be installed as a single unit.

Further, is it appreciated that another aspect of the present invention is the method of installing either the inlet (supply) or the outlet (return) replaceable tubing sections onto a transition piece, whether on a new transition piece or during replacement of an old tubing assembly on a transition piece installed in a turbine. More particularly, such method for field-installing a supply section comprises:

1. aligning a field-installable removable tubing assembly section, comprising two ends, a flexible U-bend zone and a bracing member zone comprising a support structure, so its first end meets a free end of a first pipe from a supply side port of a forced cooling fluid supply and its second end meets a free end of a second pipe from an inlet chamber port;
2. installing a first removable union to reversibly join said first end to said first pipe free end to form a non-leaking union; and 3. installing a second removable union to reversibly join said second end to said second pipe free end to form a non-leaking union.

In the methods described above, it is appreciated that, where there is a flexibility zone comprising a flexible coupling at one end, and a formed tubing zone comprising a formed tubing bend at the other end, with a bracing zone between, the flexibility at each end aids in the fitting in of the respective end to the respective adjoining mating pipe. This occurs both whether or not the bracing zone has first been attached to the transition piece via its support structure. That is, even when the bracing member is secured via its support structure to the transition piece load-receiving member, the flexibility at each end provides for an easier fit-up, with removable or other connectors, to the respective end of the respective adjoining mating pipe.

It should be understood that the examples and embodiments described herein are for illustrative purposes only and that various modifications or changes in light thereof will be suggested to persons skilled in the art and are to be included within the spirit and purview of this application and the scope of the appended claims.

We claim:

1. A replaceable section of force-cooling tubing for attachment to a transition piece of a gas turbine comprising:

a. a first end adapted to reversibly join a free end of a first pipe from a port of selectively a supply side or an return side of a forced fluid supply;

b. a second end adapted to reversibly join a free end of a second pipe from a port of selectively an inlet chamber or an outlet chamber in transition piece;

c. a bracing member connected between said first and second ends, comprising a support structure adapted to transfer load to the transition piece through a transition piece load-receiving member;

d. a flexible coupling connected between said first end and said bracing member wherein said flexible coupling is adapted to provide axial lateral flexibility; and e. a formed tubing bend connected between said second end and said bracing member, adapted to provide radial flexibility;

wherein said replaceable section provides fluid communication between said first and second ends for passage of a force-cooled fluid.

2. The replaceable section of claim 1 wherein said formed tubing bend comprises a U-shaped bend.

3. The replaceable section of claim 1 wherein said flexible coupling comprises a dual spherical coupling.

4. The replaceable section of claim 1 additionally comprising two removable unions, one adapted to join said first end to said first pipe's free end, and the other adapted to join said second end to said second pipe's free end.

5. The replaceable section of claim 4 wherein said two removable unions comprise V-band clamps.

6. The replaceable section of claim 1 wherein said support structure, abutting said transition piece load-receiving member, is adapted to transfer axial loads.

7. The replaceable section of claim 1 wherein said support structure, attaching to said transition piece load-receiving member, is adapted to transfer axial, lateral and longitudinal loads.

8. A field-installable transition piece assembly for a gas turbine comprising:

a. a transition piece adapted to fit between a combustor and a first stage of said gas turbine engine and comprising a cooling inlet chamber, outlet chamber, and a transition piece load-receiving member;

b. a first replaceable section of force-cooling tubing, comprising:

i. a first end shaped to reversibly join a free end of a first pipe from a forced cooling fluid supply supply side;

ii. a second end shaped to reversibly join a free end of a second pipe from said inlet chamber;

iii. a bracing member along said replaceable section, comprising a support structure emanating from a point along said first tubing section and positioned so as to transfer load to said transition piece load-receiving member;

iv. a flexible coupling between said first end and said bracing member; and v. a formed tubing bend between said second end and said bracing member;

c. a second replaceable section of force-cooling tubing for field installation onto said transition piece, comprising:

i. a first end shaped to reversibly join a free end of a first pipe from a forced cooling fluid supply return side;

ii. a second end shaped to reversibly join a free end of a second pipe from said outlet chamber;

iii. a bracing member along said replaceable section, comprising a support structure emanating from a point along said first tubing section and positioned so as to transfer load to said transition piece load-receiving member;

iv. a flexible coupling between said first end and said bracing member; and v. a formed tubing bend between said second end and said bracing member;

d. a removable union joining each of: said first end of said first replaceable section with said first pipe of said forced cooling fluid supply supply side; said second end of said first replaceable section with said second pipe, from said inlet chamber; said first end of said second replaceable section with said first pipe of said forced cooling fluid supply return side; and said second end of said second replaceable section with said second pipe, from said outlet chamber;

wherein said first and second replaceable sections provide fluid communication between its respective first and second ends for passage of force-cooled fluid into and from the transition piece.

9. The field-installable transition piece assembly of claim 8 wherein each said formed tubing bend comprises a U-shaped bend.

10. The field-installable transition piece assembly of claim 8 wherein said each said flexible coupling comprises a dual spherical coupling.

11. The field-installable transition piece assembly of claim 8 wherein each said support structure, abutting said transition piece load-receiving member, is adapted to transfer axial loads.

12. The field-installable transition piece assembly of claim 8 wherein each said support structure, attaching to said transition piece load-receiving member, is adapted to transfer axial, lateral and longitudinal loads.

13. A multi-zone replaceable section of force-cooled tubing for communicating cooling fluid with a transition piece of a gas turbine, comprising:

a. two ends, one adapted to join a forced cooling fluid supply and the other adapted to join said transition piece;

b. a flexibility zone comprising a flexible coupling having axial and lateral movement capabilities;

c. a formed tubing zone disposed between said two ends; and d. a bracing zone disposed between said flexible coupling and said formed tubing zone, comprising a support structure to isolate said flexible coupling from plug loads generated in said formed tubing zone.

14. The replaceable section of claim 13, wherein said formed tubing zone comprises a U-shaped bend.

15. The section of claim 14, wherein said flexible coupling comprises a dual spherical coupling.

16. The section of claim 15, further comprising a removable union at each end, wherein each said two removable union comprises a V-band clamp.

* * * * *